US010894692B2

(12) United States Patent
Matthies et al.

(10) Patent No.: US 10,894,692 B2
(45) Date of Patent: Jan. 19, 2021

(54) APPARATUS FOR FEEDING A PLURALITY OF THREADS

(71) Applicant: OERLIKON TEXTILE GMBH & CO. KG, Remscheid (DE)

(72) Inventors: Claus Matthies, Ehndorf (DE); Ludgar Legge, Ehndorf (DE); Jan Westphal, Schülp (DE); Mathias Stündl, Wedel (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 217 days.

(21) Appl. No.: 15/769,269

(22) PCT Filed: Oct. 21, 2016

(86) PCT No.: PCT/EP2016/075318
§ 371 (c)(1),
(2) Date: Apr. 18, 2018

(87) PCT Pub. No.: WO2017/072031
PCT Pub. Date: May 4, 2017

(65) Prior Publication Data

US 2018/0305169 A1 Oct. 25, 2018

(30) Foreign Application Priority Data

Oct. 28, 2015 (DE) ..... 10 2015 013 890

(51) Int. Cl.
*B65H 54/71* (2006.01)
*B65H 54/88* (2006.01)
*D01D 5/088* (2006.01)

(52) U.S. Cl.
CPC ..... *B65H 54/71* (2013.01); *B65H 54/88* (2013.01); *B65H 2402/414* (2013.01);
(Continued)

(58) Field of Classification Search
CPC .. B65H 54/71; B65H 54/88; B65H 2402/414; B65H 2701/3132; B65H 51/28;
(Continued)

(56) References Cited

U.S. PATENT DOCUMENTS

2004/0103633 A1* 6/2004 Pyra ..... D02G 1/0273 57/280

FOREIGN PATENT DOCUMENTS

CH 593377 A5 11/1977
CN 102530649 * 7/2012 ..... B65H 54/88
(Continued)

OTHER PUBLICATIONS

English Translation of Baugh DE1710649 (Year: 1971).*
(Continued)

*Primary Examiner* — Jacob T Minskey
*Assistant Examiner* — Adrien J Bernard
(74) *Attorney, Agent, or Firm* — BainwoodHuang

(57) ABSTRACT

An apparatus feeds a plurality of threads to rotating godets of a melt spinning machine including a manual injector (e.g., a main manual injector) and a cutting device. In order to be able to selectively feed the threads individually or as a bunch, a transfer device and a second manual injector (e.g., an auxiliary manual injector) are associated with the manual injector.

10 Claims, 6 Drawing Sheets

Figure 1:
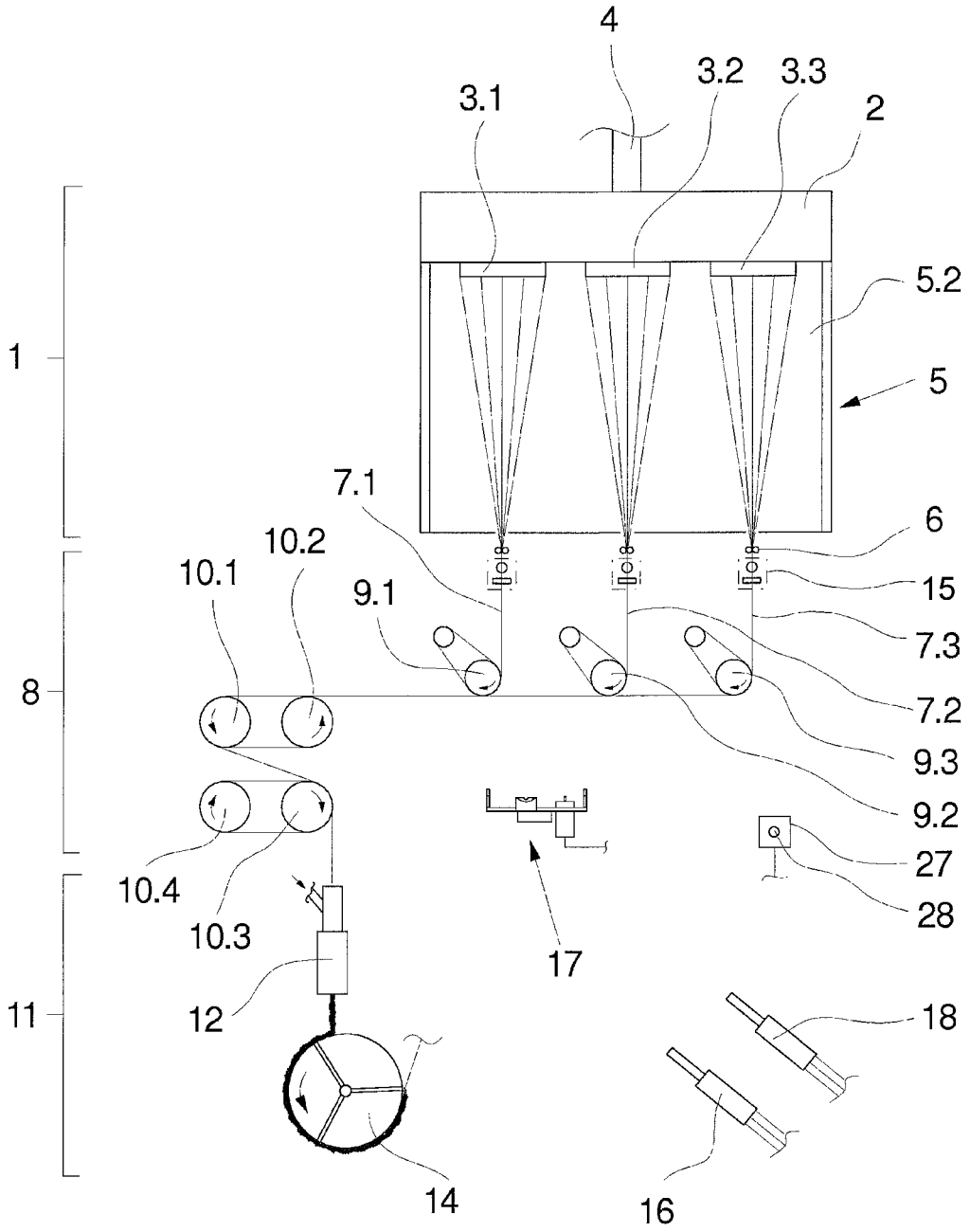

(52) U.S. Cl.
CPC .. *B65H 2701/3132* (2013.01); *B65H 2701/38* (2013.01); *D01D 5/088* (2013.01)

(58) Field of Classification Search
CPC ..... B65H 51/32; B65H 51/08; B65H 2301/4151; D01D 5/16
See application file for complete search history.

(56) References Cited

FOREIGN PATENT DOCUMENTS

| | | | | |
|---|---|---|---|---|
| DE | 1710649 | A1 | | 12/1971 |
| EP | 2407407 | A2 | | 1/2012 |
| EP | 2495203 | A2 | | 9/2012 |
| EP | 2567919 | A1 | | 3/2013 |
| JP | H01221509 | | * | 9/1989 |
| WO | 2012052203 | A1 | | 4/2012 |

OTHER PUBLICATIONS

English Translation of Inventa CH593377 (Year: 1977).*
English Translation of Hashimoto JPH01221509 (Year: 1989).*
English Translation of Reinhold CN102530649 (Year: 2012).*
English Translation of Schafer WO2012052203 (Year: 2012).*

* cited by examiner

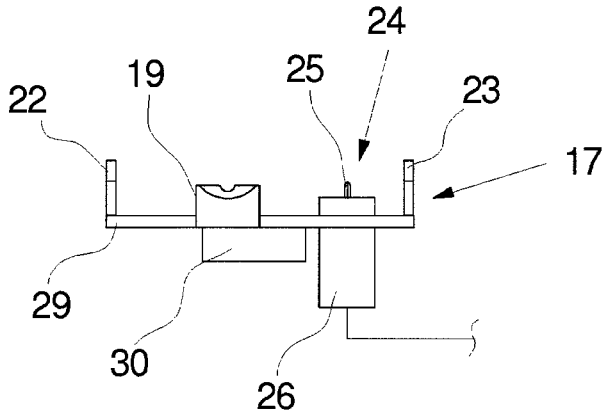
Fig.3.1
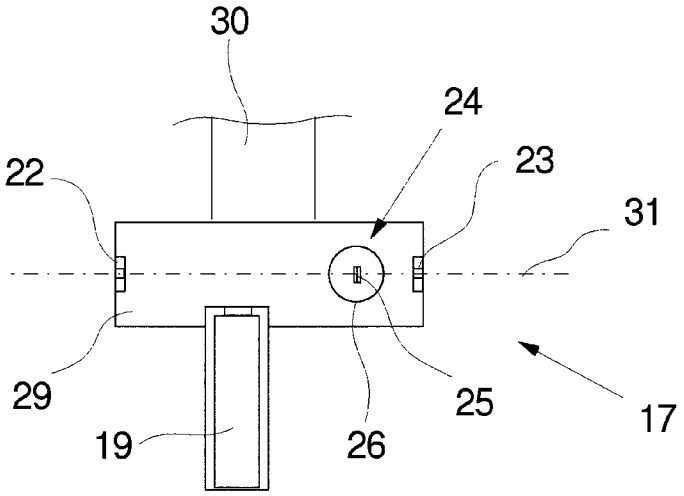
Fig.3.2

APPARATUS FOR FEEDING A PLURALITY OF THREADS

The invention relates to an apparatus for feeding a plurality of threads to rotating godets of a melt spinning machine further details of which are disclosed herein.

An apparatus of the generic type is known from DE 1 710 649 A1.

In the production of synthetic threads, they are first extruded from a polymer melt into extremely fine filament strands. After cooling down and bundling the filaments to form a thread, the latter is then treated in one or more stages, depending on the process. It is thus known to guide the threads after spinning over rotating godets, which are operated with a differential speed to stretch the threads. Similarly, intermingling, wetting or crimping operations may be performed on the threads. Depending on the respective treatment step, the threads are thereby guided as a bunch of threads or separately. Irrespective of the type of guidance, after starting spinning it is necessary in the case of every melt spinning machine to feed the threads to the treatment units, in particular to the rotating godets. The known apparatus from DE 17 10 649 has for this purpose a manual injector, which interacts with a cutting device. It is thus possible to guide one or more threads, according to choice, manually with the manual injector and feed it or them into the downstream treatment units.

There are then also known melt spinning machines in which the thread guidance to the treatment units takes place in various ways. In the case of such melt spinning machines, it is necessary that during the feeding process sometimes the threads have to be guided separately and sometimes as a bunch of threads.

The object of the invention is therefore to develop an apparatus of the generic type for feeding a plurality of threads to rotating godets of a melt spinning machine in such a way that, irrespective of the way in which the process is conducted, flexible and user-friendly handling is ensured for an operator.

A further aim of the invention is to provide an apparatus for feeding a plurality of threads to rotating godets of a melt spinning machine in which, according to choice, the threads can be guided separately or as a bunch of threads.

This object is achieved according to the invention by the manual injector being assigned a transfer device and a second manual injector.

Advantageous developments of the invention are defined by the features and combinations of features as disclosed herein.

The apparatus according to the invention is particularly advantageous for allowing the threads to be drawn off in parallel through a first group of rotating godets. Thus, the threads allow themselves to be fed individually to the circumference of the godet by one of the manual injectors. The manual injector that is usually present in the melt spinning machine for feeding all the threads is referred to in the case of this invention as the main manual injector. The second manual injector consequently represents an auxiliary manual injector, which can be used to assist the guidance of the threads. To this extent, the apparatus according to the invention offers the operator great flexibility when feeding a plurality of threads to rotating godets.

Preferred is the development of the apparatus according to the invention in which the transfer device has a placement recess for receiving an intake tube of the main manual injector and a run-in thread guide, the run-in thread guide on the transfer device being assigned to a suction end of the intake tube of the main manual injector placed into the placement recess. In this way, the main manual injector can be moved into a parking position, so that the operator can change between the main manual injector and the auxiliary manual injector. The guidance of the partially fed thread is maintained by the sucking action of the main manual injector.

To be able to continue the subsequent feeding process just with the main manual injector, a transfer and takeover of the following threads is necessary. For this purpose, the transfer device has a run-out thread guide arranged at a distance from the run-in thread guide, the run-in thread guide and the run-out thread guide defining a thread running plane with the cutting device arranged on the transfer device. Thus, the threads guided by the auxiliary manual injector can be cut in a defined position and section of the thread.

In order that a thread guided in the auxiliary manual injector can be directly taken up when it is severed, according to a development of the invention the suction end of the intake tube on the main manual injector is positioned close to the thread running plane between the run-in thread guide and the run-out thread guide. Thus, directly after severing the thread, the latter can be taken up by the suction end of the intake tube on the main manual injector.

For this purpose, the cutting device is preferably arranged on the transfer device in a region between the suction end of the placed-in intake tube on the main manual injector and the run-out thread guide.

In order that the operator can bring about a separation of the thread directly after threading the thread guided by the auxiliary manual injector, the cutting device is preferably provided with an actuator and a cutting means coupled to the actuator, the actuator being of an electrically controllable design.

Consequently, the operator can bring about an activation and severing of the thread by actuating a control button. For this purpose, the transfer device is assigned at least one operator control panel with a control button for activating the cutting device, which is arranged close enough to operate.

To be able to reliably sever both threads with fine deniers and threads with coarse deniers, the cutting means is formed by two shear halves. These can advantageously be operated by an actuator.

In order that the fewest possible additional wraparounds of the thread are caused during the feeding of the threads, particularly advantageous is the development of the invention in which the transfer device is held movably between an operating position and a rest position on a frame wall supporting the godets. Thus, the transfer device can be brought into an operating position suitable for operator control and thread guidance.

The apparatus according to the invention for feeding a plurality of threads to rotating godets is particularly suitable for feeding a bunch of threads with the threads sometimes being guided individually and sometimes being guided in a bunch. To this extent, the method according to the invention, in which all the threads at the end are guided together by the main manual injector, has proven successful. For this purpose, when separately feeding the threads, first a first spun thread is taken over by the main manual injector and guided around the rotating godets. Then, the thread is threaded into the run-in thread guide of the transfer device and the main manual injector is parked with its suction tube in the transfer device. Then the operator changes to the auxiliary manual injector, in order to take over a next neighboring spun thread and guide it to the godets. Subsequently, the thread is threaded into the run-in thread guide and a run-out thread guide on the transfer device. After that, the operator triggers an activation of the cutting device for severing the thread, a loose end of the thread being taken up by the main manual injector. This operation can be repeated for each further neighboring thread, so that at the end of the process of feeding to the godets, all of the threads can be guided together by the main manual injector. To this extent, there is the possibility of guiding the bunch of threads into downstream treatment units.

The apparatus according to the invention for feeding a plurality of threads is described in more detail below on the basis of an exemplary embodiment.

Figure 2:
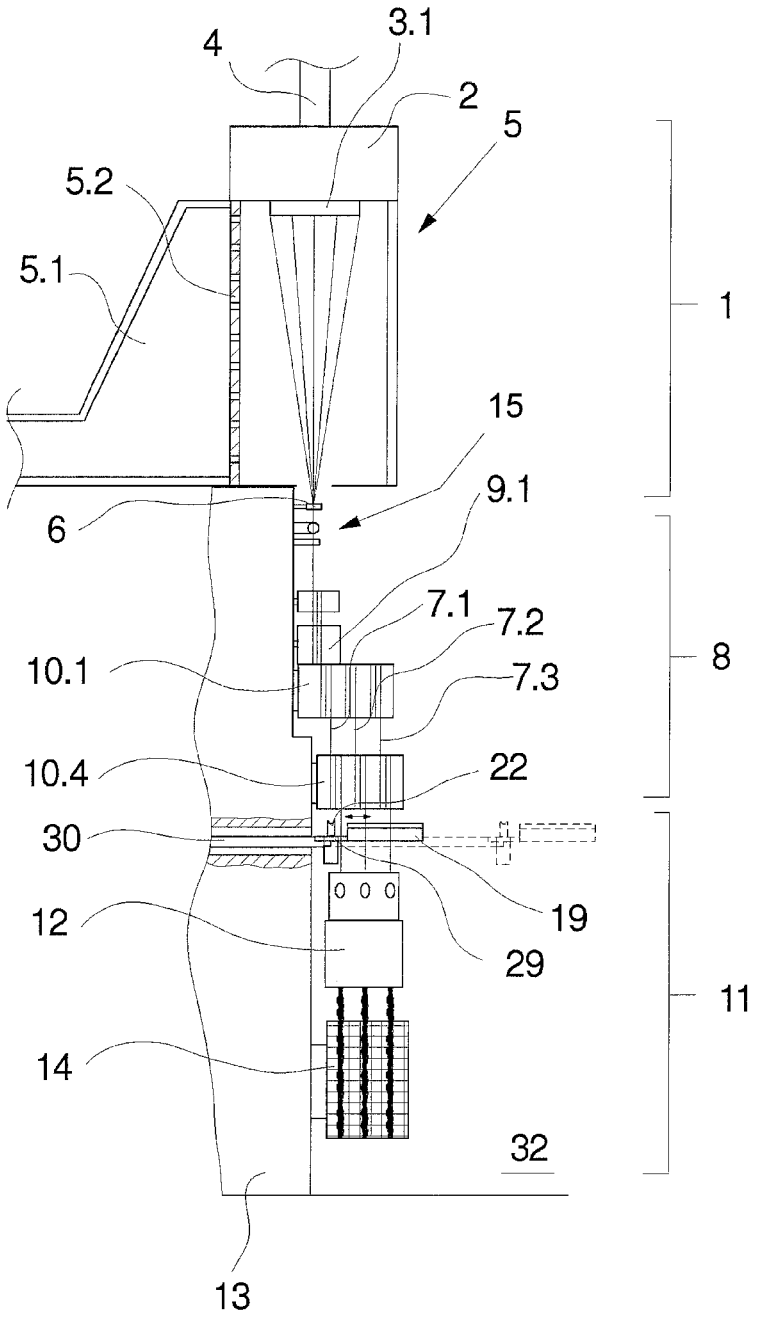

In the figures:

FIG. 1 schematically shows a front view of a melt spinning machine with an apparatus according to the invention FIG. 2 schematically shows the exemplary embodiment from FIG. 1 in a side view FIG. 3 schematically shows a number of views of a transfer device according to the exemplary embodiment from FIG. 1

Figure 4:
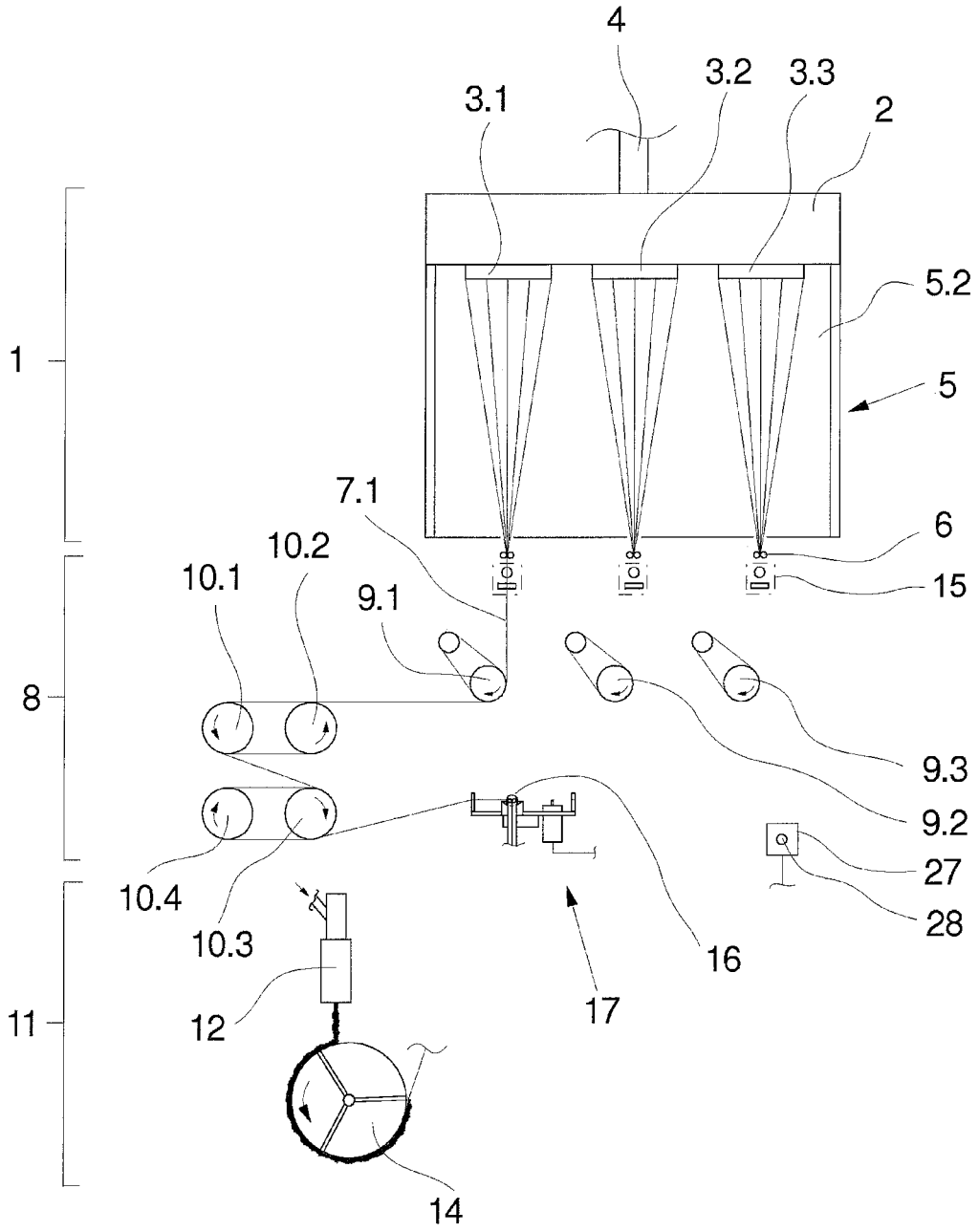
Figure 5:
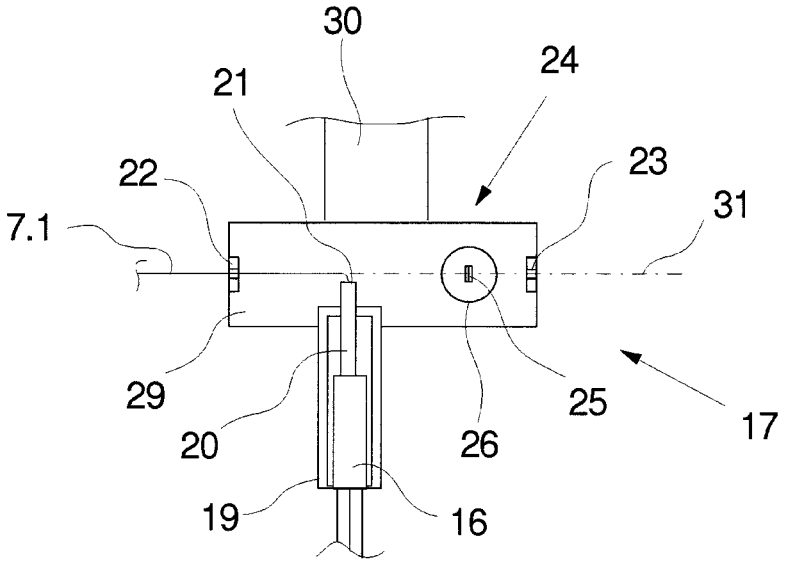
Figure 7:
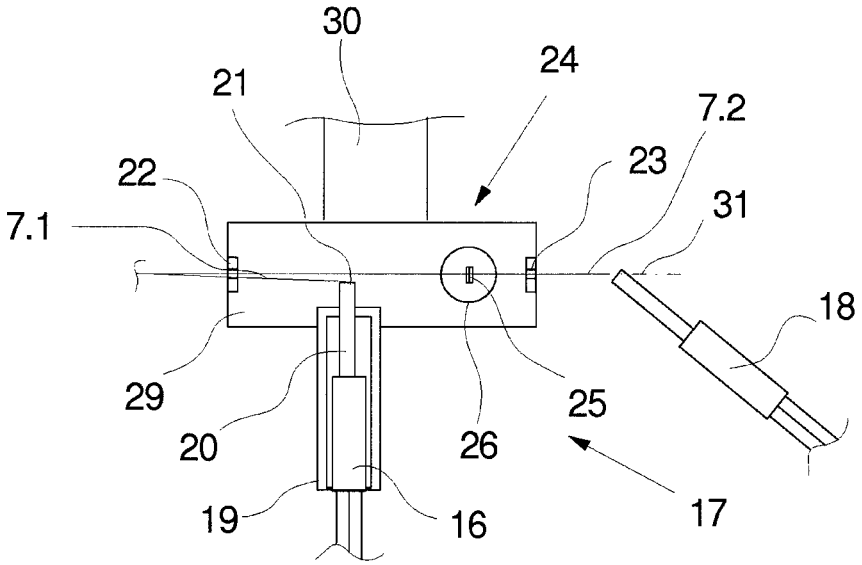
Figure 6:
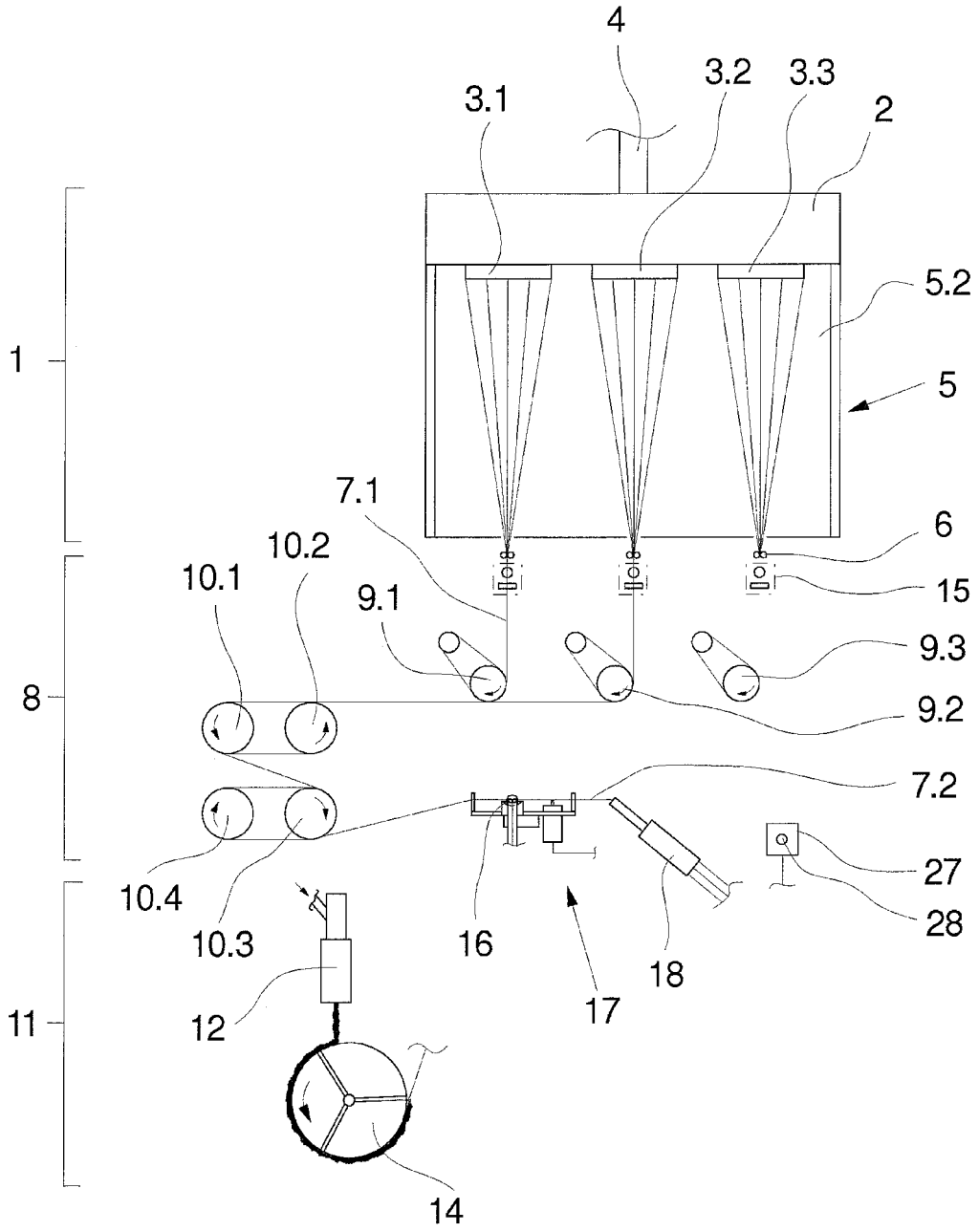

FIG. 4 schematically shows the exemplary embodiment from FIG. 1 when feeding a first thread FIG. 5 schematically shows a plan view of the apparatus according to the invention during the feeding operation FIG. 6 schematically shows the exemplary embodiment from FIG. 1 when feeding a second thread FIG. 7 schematically shows a plan view of the apparatus according to the invention during the feeding operation.

In FIGS. 1 and 2, an exemplary embodiment of the apparatus according to the invention for feeding a plurality of threads is represented together with a melt spinning machine in several views. FIG. 1 shows a front view of the melt spinning machine and FIG. 2 shows a side view. If no express reference is made to one of the figures, the following description applies to both figures.

The melt spinning machine is only partially represented here, with a spinning device 1, a stretching device 8 and a crimping device 11, which are arranged one behind the other to form a thread run.

Usually, after being reduced to a single thread, the threads crimped in this way undergo an aftertreatment by relaxation and intermingling. At the end, such melt spinning machines have a winding-up device, in order to wind the threads individually to form packages. The aftertreatment device and the winding-up device are not described any further at this point.

The spinning device 1 has a spinning beam 2 and three spinnerets 3.1, 3.2 and 3.3 arranged next to one another on the underside of the spinning beam 2. The spinning beam 2 is usually of a heated design and includes a melt distributor system and also one or more spinning pumps. A polymer melt supplied by a melt source is fed to the spinnerets 3.1 to 3.3 by way of a feed 4.

Provided underneath the spinning beam 2 is a cooling device 5, in order to cool down the filament strands extruded through the spinnerets 3.1 to 3.3. In this exemplary embodiment, the cooling device 5 has a blowing chamber 5.1 and a blowing wall 5.2, which is facing the filament strands.

Underneath the cooling device 5, each spinneret 3.1 to 3.3 is respectively assigned a collective thread guide 6 for bundling the filaments to form in each case a thread 7.1, 7.2 and 7.3.

Provided underneath the collective thread guide 6 is a suction cutting device 15, in order in the event of thread breakage or when starting spinning to take up the threads continuously and convey them to a waste container.

The threads 7.1, 7.2 and 7.3 are drawn off individually by a plurality of draw-off godets 9.1 to 9.3. Arranged downstream of the draw-off godet units 9.1 to 9.3 is the stretching device 8. In this exemplary embodiment, the stretching device 8 has a number of godets 10.1 to 10.4, which in each case form two pairs of godets, in order to stretch the threads 7.1, 7.2 and 7.3. For this purpose, the godets 10.1 to 10.4 usually have heated godet sleeves. The godets 10.1 to 10.2 are coupled to drives, in order in particular to be able to set a differential speed between the pairs of godets.

The stretching device 8 is followed in the thread run by the crimping device 11, which in this exemplary embodiment of the melt spinning machine is formed by a texturing unit 12 and a cooling drum 14. The texturing unit 12 preferably has a number of conveying nozzles, in order to convey the threads 7.1 to 7.3 separately into in each case a connected stuffer box. On the outlet side of the texturing unit 12, the threads are removed as thread plugs and placed on the circumference of the cooling drum 14. After cooling down of the thread plugs on the circumference of the cooling drum, they are in each case drawn off to form a crimped thread.

As emerges in particular from the representation in FIG. 2, the stretching device 8 and the crimping device 11 are arranged projecting from a frame wall 13. The frame wall 13 is assigned in front an operator aisle 32, which extends on a longitudinal side of the machine. To this extent, the stretching device 8 and the crimping device 11 are operated from the operator aisle 32.

In FIGS. 1 and 2, the melt spinning machine is represented in an operating situation in which the threads are continuously stretched, crimped and aftertreated and are also wound up. In order to be able to start the process for producing the crimped threads, it is necessary that, after starting spinning in the spinning device 1, an operator places the threads 7.1 to 7.3 against the draw-off godet units 9.1 to 9.3 and into the stretching device 8. For this purpose, the operator uses the apparatus according to the invention, which is schematically represented in FIGS. 1 and 2.

The exemplary embodiment of the apparatus according to the invention has a main manual injector 16, which is manually guided and is connected to a waste container not shown here. The main manual injector 16 is assigned a transfer device 17 and also an auxiliary manual injector 18. The auxiliary manual injector 18 can likewise be freely guided manually and is connected to a waste container not shown here. The transfer device 17 is arranged movably on the frame wall 13. For this purpose, the transfer device 17 has a thrust mount 30, which is guided displaceably on the frame wall 13.

For further explanation of the transfer device 17, reference is additionally made to FIG. 3, which shows a number of views of the transfer device 17. In FIG. 3.1, a front view is shown and in FIG. 3.2, a plan view is shown. Arranged at the free end of the thrust mount 30 is a supporting plate 29. Arranged on the supporting plate 29 are a run-in thread guide 22, on a run-in side, and a run-out thread guide 23, on a run-out side. Arranged projecting laterally on the supporting plate 29, between the run-in thread guide 22 and the run-out thread guide 23, is a placement recess 19. In the region between the placement recess 19 and the run-out thread guide 23, a cutting device 24 is held on the supporting plate 29. The cutting device 24 has a cutting means 25 and an actuator 26. The actuator 26 can be controlled by a control button 28 on an operator control panel 27. The operator control panel 27 is held on the frame wall 13.

For explanation of the apparatus according to the invention for feeding the threads, reference is made below to FIGS. 4 and 5 and also 6 and 7.

In FIG. 4, the front view of the melt spinning machine is shown, a first thread being fed to the draw-off godet unit 9 and the stretching device 8. FIG. 5 schematically shows a plan view of the apparatus according to the invention in the situation according to FIG. 4.

To be able to start a process, the operator will guide the main manual injector 16 to take over the thread 7.1 from the spinning device 1 and first place it against the draw-off godet unit 9 and also the downstream godets 10.1 to 10.4 of the stretching device. After that, the thread 7.1 is threaded into the run-in thread guide 22 of the transfer device 17 and the main manual injector 16 is placed into the placement recess 19 of the transfer device 17 for parking. This situation is represented in FIG. 5.

In FIG. 5, the transfer device 17 is shown in plan view, the thrust mount 30 with the supporting plate 29 being held in an extended position on the frame wall 13. The run-in thread guide 22 and the run-out thread guide 23 form together with the cutting device 24 lying in between a thread running plane 31. The thread running plane 31 is represented in FIG. 5 by a broken line.

In the parking situation of the main manual injector 16, an intake tube 20 of the main manual injector 16 protrudes with a suction end 21 up to the thread running plane 31. The placement recess 19 has for this purpose stops that are not shown any more specifically, in order to be able to position the intake tube 20.

In the feeding situation represented, the thread 7.1 is continuously taken up by the main manual injector 16 and carried away.

Then the operator takes the auxiliary manual injector 18, in order to take over a neighboring thread in the spinning device 1. FIG. 6 shows the melt spinning machine with the apparatus according to the invention in a front view and FIG. 7 shows the apparatus according to the invention in a plan view.

If no express reference is made to one of the figures, the following description applies to both figures.

As emerges from the representation in FIG. 6, the thread 7.2 can be placed with the aid of the auxiliary manual injector 18 against the draw-off godet unit 9.2 and the godets 10.1 to 10.4. Subsequently, the thread 7.2 is threaded into the run-in thread guide 22 and the run-out thread guide 23 of the transfer device 17. In this situation, the thread 7.2 is guided in the thread running plane 31 and continuously taken up by the auxiliary manual injector 18 and conveyed to a waste container.

Then the operator actuates the control button 28, in order to activate the cutting device 24. The thread 7.2 is severed by the cutting means 25 within the transfer device 17. The cutting means 25 is preferably formed here by two shear halves, which move oppositely toward one another in order to sever the thread 7.2.

Once the thread 7.2 is severed, the loose thread end of the thread 7.2 is sucked in by the suction force of the intake tube 20 on the main manual injector 16, and is consequently taken over by the main manual injector 16.

Then the main manual injector 18 is free to be able to feed the next thread from the spinning device 1. The previously described operation is repeated, so that after severing of the thread 7.3 in the transfer device 17 all of the threads are guided together by the main manual injector 16. The further feeding process is performed by the main manual injector 16, the threads 7.1, 7.2 and 7.3 being guided together as a bunch of threads.

The apparatus according to the invention is consequently particularly suitable for feeding the threads separately and individually with multiple wraparounds to long-projecting godets. Once the feeding operation is ended, the transfer device 17 is returned again, to stay in a retracted position.

The melt spinning machine represented in FIGS. 1 and 2 and also the number of spinnerets are only by way of example. In principle, the method according to the invention also allows more than three threads to be guided separately or together for feeding.

The invention claimed is:

1. A method for feeding a plurality of spun threads to rotating godets of a melt spinning machine, the method comprising:

a. taking over a first initially spun thread by a main manual injector and guiding the thread around a plurality of rotating godets, b. threading the thread into a run-in thread guide of a transfer device and parking the main manual injector with a positioned suction tube, c. taking over a neighboring initially spun thread by an auxiliary manual injector and guiding the neighboring initially spun thread around a plurality of rotating godets, d. threading the neighboring initially spun thread into the run-in thread guide and a run-out thread guide on the transfer device, e. triggering a cutting device for severing the neighboring initially spun thread, a loose end of the neighboring initially spun thread being taken up by the main manual injector, and f. repeating steps c to e until all of the threads can be guided on the main manual injector.

2. An apparatus for feeding a plurality of threads to rotating godets of a melt spinning machine, the apparatus comprising:

a transfer device;

a main manual injector constructed and arranged to take in a first thread and, while continuously taking in the first thread, guide the first thread among the rotating godets and park on the transfer device; and a second manual injector constructed and arranged to take in a neighboring thread and, while continuously taking in the neighboring thread, guide the neighboring thread among the rotating godets and thread the neighboring thread on the transfer device;

wherein the transfer device is constructed and arranged to cut the neighboring thread so that the main manual injector takes in the neighboring thread while continuously taking in the first thread to form a bunch of threads for further guidance by the main manual injector.

3. The apparatus as claimed in claim 2, wherein the transfer device has a placement recess for receiving an intake tube of the main manual injector and a run-in thread guide, the run-in thread guide on the transfer device being assigned to a suction end of the intake tube of the main manual injector placed into the placement recess.

4. The apparatus as claimed in claim 3, wherein the transfer device has a run-out thread guide arranged at a distance from the run-in thread guide, the run-in thread guide and the run-out thread guide defining a thread running plane with a cutting device arranged on the transfer device for cutting the neighboring thread.

5. The apparatus as claimed in claim 4, wherein the suction end of the intake tube on the main manual injector can be positioned close to the thread running plane between the run-in thread guide and the run-out thread guide.

6. The apparatus as claimed in claim 5, wherein the cutting device is arranged on the transfer device in a region between the suction end of the placed-in intake tube on the main manual injector and the run-out thread guide.

7. The apparatus as claimed in claim 2, wherein a cutting device for cutting the neighboring thread is provided with an actuator and a cutting means coupled to the actuator, the actuator being of an electrically controllable design.

8. The apparatus as claimed in claim 7, wherein the transfer device is assigned at least one operator control panel with a control button for activating the cutting device.

9. The apparatus as claimed in claim 7, wherein the cutting means is formed by two shear halves.

10. The apparatus as claimed in claim 2, wherein the transfer device is held movably between an operating position and a rest position on a frame wall supporting the godets.

* * * * *